US007134788B2

(12) United States Patent
Hsiang

(10) Patent No.: US 7,134,788 B2
(45) Date of Patent: Nov. 14, 2006

(54) RESEALABLE BAG WITH TOP TEAR-AWAY HEADER AND ZIPPER AND METHOD OF MANUFACTURING THE SAME

(76) Inventor: Chia Hsiang, 6898 Mountain Dr., Troy, MI (US) 48098

( * ) Notice: Subject to any disclaimer, the term of this patent is extended or adjusted under 35 U.S.C. 154(b) by 293 days.

(21) Appl. No.: 10/459,286

(22) Filed: Jun. 11, 2003

(65) Prior Publication Data

US 2004/0252914 A1 Dec. 16, 2004

(51) Int. Cl.
*B65D 33/16* (2006.01)
*B65D 33/10* (2006.01)

(52) U.S. Cl. ..... 383/64; 383/9

(58) Field of Classification Search ..... 383/61.2, 383/5, 203–204, 9, 63–64
See application file for complete search history.

(56) References Cited

U.S. PATENT DOCUMENTS 3,722,786 A 3/1973 Honn
3,844,409 A 10/1974 Bodolay
3,974,958 A 8/1976 Ruda
3,982,574 A 9/1976 Bianchi
4,560,068 A 12/1985 Membrino
4,744,674 A * 5/1988 Nocek ..... 383/63
5,096,516 A * 3/1992 McDonald et al. ..... 156/66
5,118,202 A 6/1992 Bruno
5,131,121 A 7/1992 Herrington, Jr.
5,417,495 A 5/1995 Branson
5,419,437 A 5/1995 Huseman
5,480,230 A 1/1996 May
5,540,032 A 7/1996 Sosnik
5,590,784 A 1/1997 Daniels
5,669,715 A * 9/1997 Dobreski et al. ..... 383/5
5,682,730 A 11/1997 Dobreski
5,713,669 A * 2/1998 Thomas et al. ..... 383/204
5,860,905 A 1/1999 Bruno
5,896,627 A 4/1999 Cappel
6,129,959 A 10/2000 Mercer
6,149,565 A 11/2000 Meyer
6,247,843 B1 * 6/2001 Buchman ..... 383/5
6,273,607 B1 * 8/2001 Buchman ..... 383/5
6,290,390 B1 * 9/2001 Buchman ..... 383/5
6,290,391 B1 * 9/2001 Buchman ..... 383/5
6,439,770 B1 8/2002 Catchman
6,488,410 B1 * 12/2002 Schneider ..... 383/5

(Continued)

*Primary Examiner*—Jes F. Pascua
(74) *Attorney, Agent, or Firm*—Gifford, Krass, Groh, Sprinkle, Anderson & Citkowski, P.C.

(57) ABSTRACT

A resealable plastic bag having a substantially planar shaped body exhibiting first and second opposing panels, sealingly connected along a pair of sides and with a bottom interconnecting the sides such that the body forms an interior receptacle volume. A pair of re-sealable bead portions are integrally formed into the planar shaped body and arranged at first and second opposing and extending locations along a top of the body. A header is integrally formed with the planar shaped body and in proximity to the bead portions. A perforation line is established between the header and resealable bead portions, in order to facilitate tear-away removal of the planar shaped body from the header. A sliding zipper is attached to the bag and in order to contain the resealable bead portions therebetween. A plurality of headers can be heat staked together and in order to support a like plurality of bags. A method for constructing a resealable plastic bag is also disclosed according to the above structure and which utilizes a die extrusion process in the bag and header manufacture.

13 Claims, 9 Drawing Sheets

U.S. PATENT DOCUMENTS 6,536,951 B1 3/2003 Sill
6,786,640 B1 * 9/2004 Schneider et al. ..... 383/5
2003/0044093 A1 3/2003 Schneider
2003/0063819 A1 4/2003 Cappel
2003/0185468 A1 * 10/2003 Keith et al. ..... 383/9

* cited by examiner

RESEALABLE BAG WITH TOP TEAR-AWAY HEADER AND ZIPPER AND METHOD OF MANUFACTURING THE SAME

BACKGROUND OF THE INVENTION

1. Field of the Invention

The present invention relates generally to plasticized and resealable bags. More specifically, the present invention discloses a resealable bag and method of constructing the same in a single piece extrusion, and exhibiting both a top tear-away header and an attachable zipper operating in communication with first and second resealable beads formed into the bag.

2. Description of the Prior Art

The prior art is well documented with various types of resealable and plasticized bag constructions. The purpose of such bag constructions is to efficiently and inexpensively store items, such as solid and liquid edibles, in a sanitary and secure fashion.

A first example of the prior art is U.S. Pat. No. 6,536,951, issued to Sill, and which discloses a plastic bag including first and second opposing body panels fixedly connected to each other along a pair of sides and a bottom bridging the pair of sides to form a receptacle space having a mouth formed opposite the bottom. A reclosable fastener extends along the mouth and an overlay strip is connected to the body panels at the sides thereof.

The overlay strip overlays at least a portion of the body panels, extends beyond the panels, and typically includes a header portion having at least one opening for mounting the plastic bag to a dispensing post, as well as a perforation line such that the header is removable from the remainder of the overlay strip. The arrangement of the overlay strip and header is further such that it is disposed along an edge of the bag opposite that of the reclosable fastener and it is further disclosed in Sill that the strip and header are formed by plasticized portions which are separately attachable to the bag, such as through a heat staking process.

U.S. Pat. No. 5,682,730, issued to Dobreski, teaches another plastic bag design exhibiting a first (top) resealable end and a second (bottom) header-attached end. As described, Dobreski includes first and second opposing panels fixedly connected to each other along a pair of sides, a primary bottom and a secondary bottom which extend between the pair of sides. The sides and secondary bottom define a receptacle space having a mouth formed opposite the secondary bottom. The bottom disposed header extends between the primary and secondary bottoms and includes first and second opposing header panels. The first header panel is extruded with and extends downwardly from the first body panel and the second header panel is extruded with and extends downwardly from the second body panel. The bottom header further includes an opening for mounting the plastic bag to a dispensing post.

Finally, Patent Application Publication No. US 2003/0044093 A1, issued to Schneider et al., teaches a tamper evident and reclosable slider package formed by opposing panels of web with four sealed sides. A zipper is sealed within the bag and such that a first zipper profile is sealed to a first opposing panel and a second zipper profile is sealed to a second opposing panel. A slider engaging the zipper profiles in a closed position protrudes from an opening in at least one of the opposing panels and may be further secured in place by a label. The slider cannot be moved from the position wherein the zipper profiles are closed to the position wherein the zipper profiles are open prior to the user tearing a perforated or otherwise weakened line across the panels, the existence of the tear providing effective tamper indication.

SUMMARY OF THE PRESENT INVENTION

The present invention is a resealable bag, constructed in a single piece extrusion, and exhibiting both a top tear-away header and an attachable zipper operating in communication with first and second resealable beads formed into the bag. Of note, the resealable plastic bag and method of manufacture makes possible the provision of a plurality of tear-away bags, formed integrally with associated header portions and such as in an extrusion die process, and which further enables a user to pre-load product within the bag prior to tearing away from the associated header.

Each resealable bag further includes a pair of bead portions, formed during the initial die extrusion process, and which, upon removal from the die, are interengaged in combination with heat staking (closing) the opposite extending sides of the bag to define the reclosable opening. A width of the body is sectioned, in proximity to the bead portions, and in order to define the bag enclosure and header portions.

A plurality of perforations are then formed along a width of the header, proximate the resealable bead portions, and in order to establish a tear-away line from removing the bag from the previously integrally formed header. Sections of opposite extending edges of the bag header are removed, such as again by cutting, and in order to define a recess in proximity to the reclosable portions and for the installation of a sliding zipper over the reclosable portions. A heat staking or other suitable mechanical fastening process can be employed for securing together a plurality of headers and like plurality of attached bags and it is further envisioned that a pair of resealable bag portions can be formed on opposite sides of a selected header and in order to establish the resealable plastic bag in back-to-back or saddlebag fashion.

A related method of manufacturing is also disclosed for producing a resealable bag according to that described above. The method includes, most broadly, the steps of extruding a body within a cylindrical shaped die, such that the body includes at least first and second resealable bead portions located at first and second width extending locations and flattening the planar shaped body upon removal from the die and such that said resealable bead portions are interengaged.

Additional steps include sectioning a width of the body, in proximity to the interengaged bead portions, and in order to define a first bag enclosure portion and a second header portion, as well as establishing a plurality of perforations, along the width of the header portion and proximate the resealable bead portions. Further steps include, among others, heat sealing first and second extending sides of the bag enclosure portion to define a sealed interior, attaching a zipper to the resealable bead portions at selected sectioned edge locations, and forming apertures in the header portions to facilitate suspending thereof of the resealable bags in top-loading fashion.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
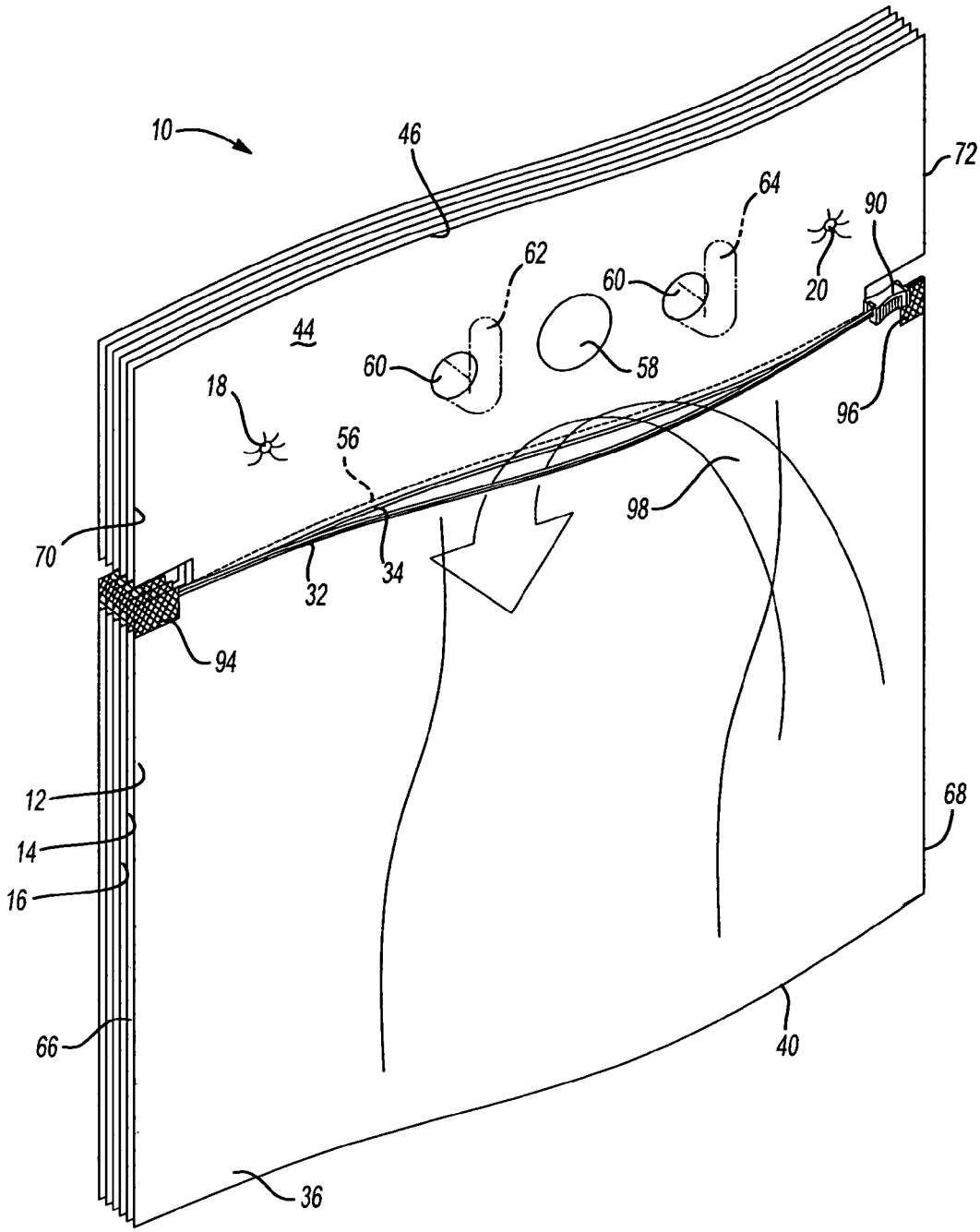
FIG. 1 is a perspective view of the resealable bag according to a first preferred embodiment of the present invention and illustrating the configuration of the tear-away header on the same end as the resealable and zippered opening.

Referring now to FIG. 1, a plurality of tear-away and resealable bag devices are illustrated, as generally shown at 10, according to a first preferred embodiment of the present invention. As previously discussed, the present invention discloses a resealable bag and method of constructing the same in a single piece extrusion, exhibiting both a top tear-away header and with resealable beads and an attachable zipper, in proximity to the tear-away header. As is also shown in each of FIGS. 1 and 2, the plurality of bags are illustrated at 12, 14, 16, et seq., and it is contemplated that bundles, such as for example of 50 such bags, are attached together, by heat stapling (heated needle) at locations 18 and 20 and in order to thermally bond together the material associated with the bags.

Figure 3:
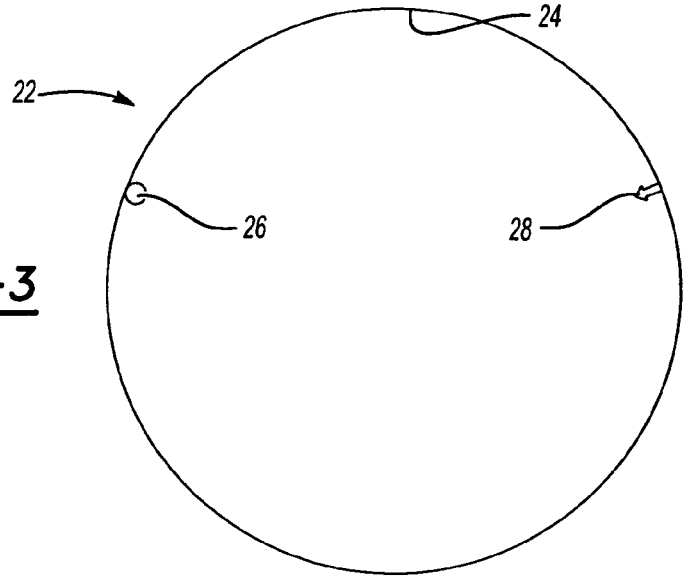
FIG. 3 is a two-dimensional end view of an extrusion die for producing the plasticized bag according to the embodiment of FIG. 1.

Referring to FIGS. 3–10, a series of assembly views are shown in succession and which illustrate the manner in which a specified and resealable plasticized bag is produced. FIG. 3 illustrates at 22 a two-dimensional end view of an extrusion die which is utilized in the production of the plasticized bags according to the invention.

In particular, the die 22 is arranged in a substantially cylindrical shape and includes a smooth and arcuate inner surface 24 constructed of a suitable metallic or like composition which is well suited for vacuum forming/extruding there-against a suitable and plasticized material in a continuous and sheet-like fashion. The arcuate inner surface 24 of the die is further characterized by first 26 and second 28 projections which, as will be subsequently described, facilitate the creation of the re-sealable bead portions in the plasticized bag.

Figure 4:
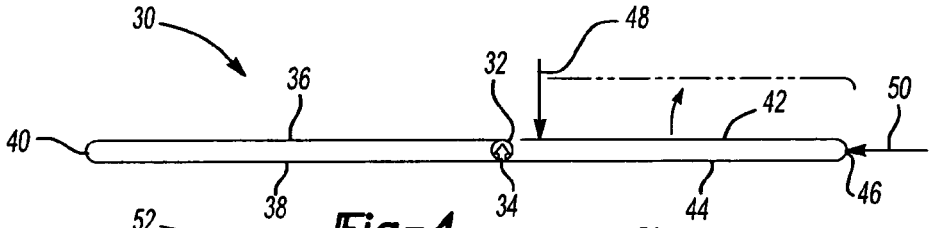
FIG. 4 is a successive and flattened end view of a bag produced in the die according to FIG. 3 and prior to removal of a portion of the integrally formed header.

FIG. 4 further illustrates at 30 a successive and flattened end view of a plasticized bag produced in the die 22 according to FIG. 3. In this illustration, the resealable bead portions are illustrated at 32 and 34 in interengaged fashion and so that the bag adopts a generally closed loop configuration. In this configuration, the bag exhibits a substantially planar shaped body having a first compartment, arranged on one side of the resealable beads 32 and 34, and defined by first 36 and second 38 opposing panels and a bottom 40. A header defines a generally second compartment on the opposite side of the resealable beads 32 and 34 in FIG. 4 and includes panels 42 and 44 and a top-most end 46.

In one preferred variant, it is desired to remove a portion of the material corresponding to the header and in order to size the bag for proper tear-away dispensation. In this variant, knife-edge incisions are made along the width of the header and at locations 48 and 50 as illustrated in FIG. 4.

Figure 5:
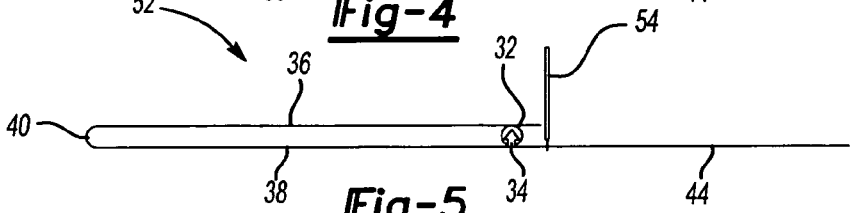
FIG. 5 is a further succeeding view of the bag illustrated in FIG. 4, showing the removal of the indicated portion of the header, as well as the creation of perforations between the header and bag.

Referring further to FIG. 5, a further succeeding view of the bag illustrated in FIG. 4 is shown at 52, and by which the portion of the header indicated by panel 42 is removed, in favor of the remaining panel 44. As is also understood, a single incision along 48 may be performed and in order to create an even longer header portion for suspending the bag.

Figure 6:
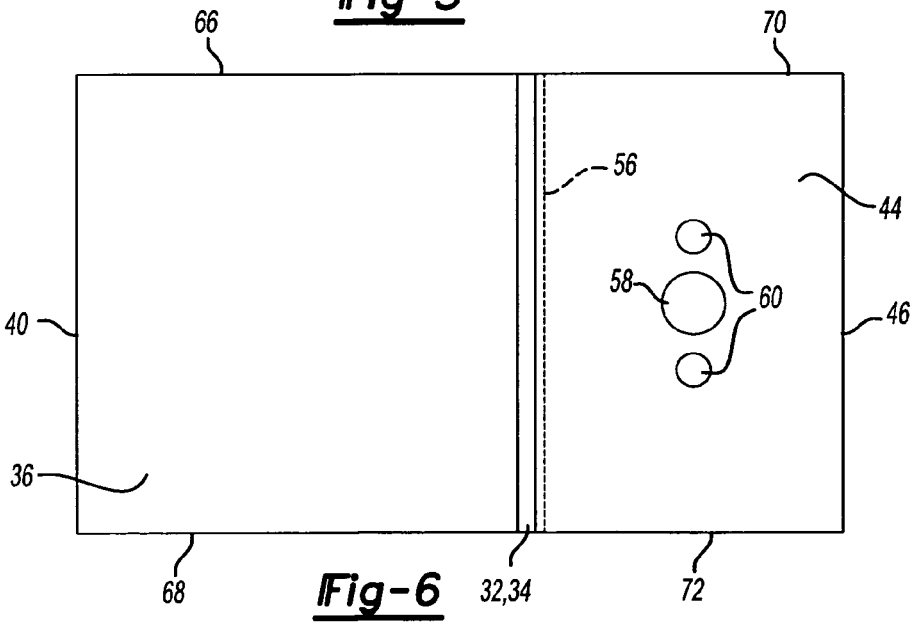
FIG. 6 is a further planar view illustration of an intermediate assembly step and further showing the apertures formed through the header portion for suspending the bag.

As is also shown in FIG. 5, a pin 54 is utilized to establish a plurality of perforations, see further at 56 in FIG. 6, between the header (panel 44) and the resealable bead portions 32 and 34 defining an inserting end location of the bag. A further intermediate assembly step associated with FIG. 6 includes the formation of apertures 58 and 60 formed through the header portion (again panel 44) for suspending the bag from any type of hook arrangement, see at 62 and 64 in FIGS. 1, 2 and 2A. The planar illustration of FIG. 6 further shows sides 66 and 68 associated with the resealable bag portion, as well as sides 70 and 72 associated with the header panel 44, it being understood that the sides 66 and 68 of the bag portion are, as yet, unsealed.

Figure 7:
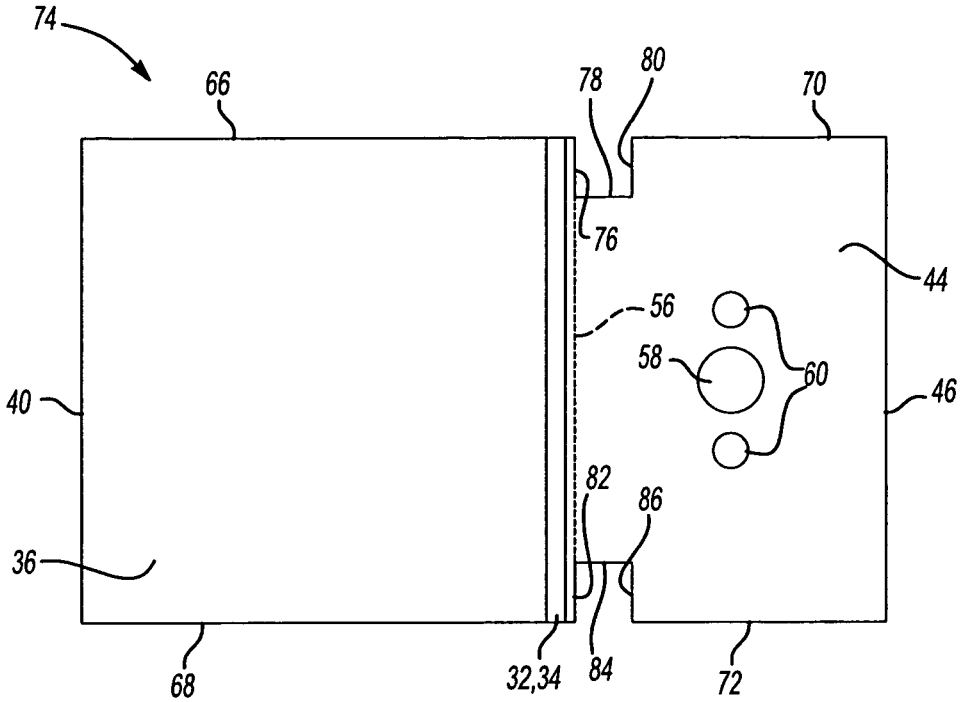
FIG. 7 is a succeeding assembly step to that shown in FIG. 6 and illustrating the recessed notches formed between the header and resealable closure portions of the plasticized bag.

Referring further to FIG. 7, a succeeding assembly step is illustrated generally at 74 and by which a pair of recessed notches are formed between the header 44 and resealable closure portions 32 and 34 of the plasticized bag. In particular, the notches are defined by incised surfaces 76, 78 and 80, as well as 82, 84 and 86 corresponding to each of the sides 70 and 72 of the header panel 44 in close proximity to both the tear-away perforations 56 and the resealable beads 32 and 34.

Figure 8:
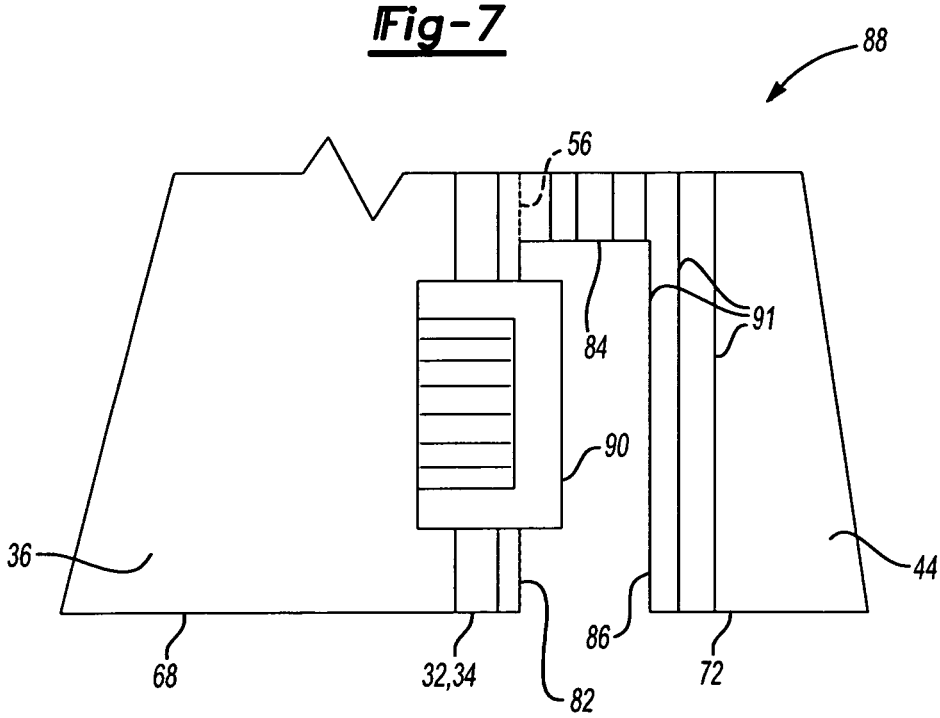
FIG. 8 is an enlarged partial view illustrating the manner in which the sliding zipper is mounted to the reclosable portions and in proximity to the notched recesses.

As further shown in FIG. 8, enlarged partial view 88 illustrates the manner in which a sliding zipper 90 is mounted over the reclosable portions 32 and 34 and within the notched recess defined by the incised surfaces 82, 84 and 86. Although not shown in great detail, the zipper 90 is understood to be of a conventional construction and one by which the inter-engaging bead portions 32 and 34 are converted between sealed and unsealed conditions depending upon the direction of the zipper's translation. Also shown in the partial illustration of FIG. 8 are a plurality of strengthening ribs 91 which are formed from the material of the header panel 44 and which provides strength to the header during tear-away of the resealable bag portion from the header panel 44 and along perforation line 56.

Figure 9:
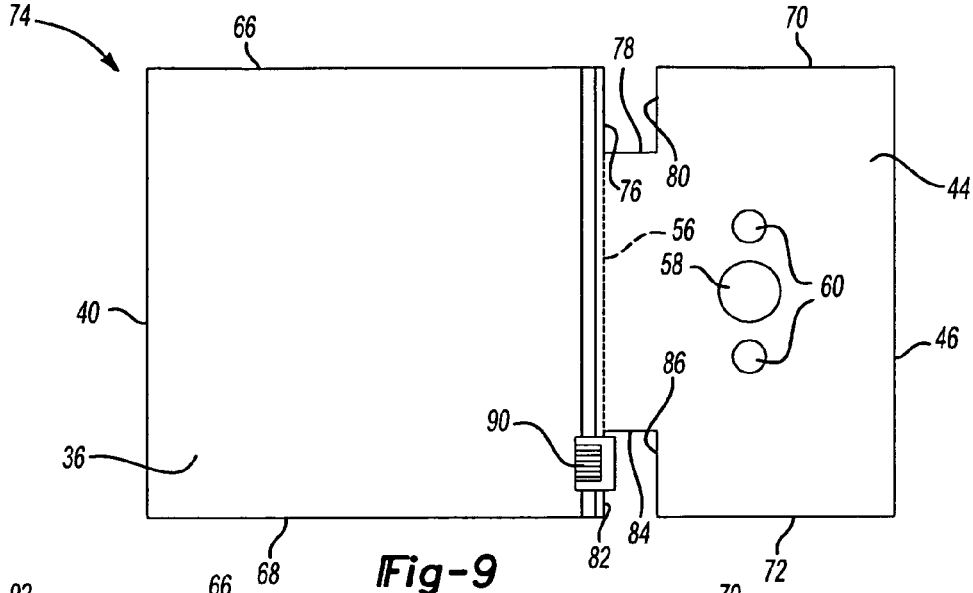
FIG. 9 is a substantially assembled view of the resealable bag design.
Figure 10:
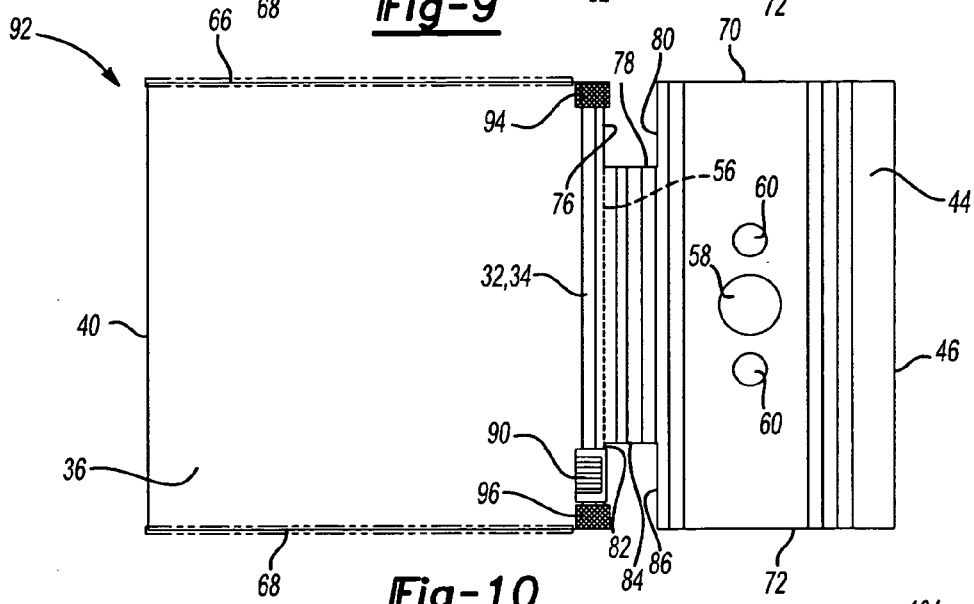
FIG. 10 is a completed assembly view of the resealable bag design and in which the opposite extending edges are heat staked to an enclosed configuration.

Referring to FIG. 9, a substantially assembled view of the resealable bag design of FIG. 7 is again illustrated and by which the zipper 90 is mounted (such as manually) in place in the fashion shown in FIG. 8. As successively shown at 92 in FIG. 10, a completed assembly view of the resealable bag design is shown and by which the opposite extending edges 66 and 68 are heat staked to an enclosed configuration. As further referenced at 94 and 96 in FIG. 10, ends of the resealable beads 32 and 34 are compressed into a flattened configuration, such as through the use of a knurled faced pinching tool (not shown) to thereby prevent the slider 90 from becoming laterally disengaged from the bag as well as to provide for secure gripping of the bag during opening and closing of the zipper. Additional pluralities of gripping ribs 91 are also shown at specified locations along the header.

Referring back again to FIG. 1, the plurality of completed resealable bags are again illustrated in bunched and heat stapled fashion and further by which they are suspended in readily tear-away fashion. A unique advantage provided by the design according to the present invention is the ability to preload product (not shown) into the reclosable bag interior, such as through the resalable bead portions 32 and 34. Of note, the product is loaded in an upside inserting direction as indicated by the direction of arrow 98, and prior to tear-away removal of the bag from the header as further illustrated by arrow 100 in FIG. 2.

Figure 2:
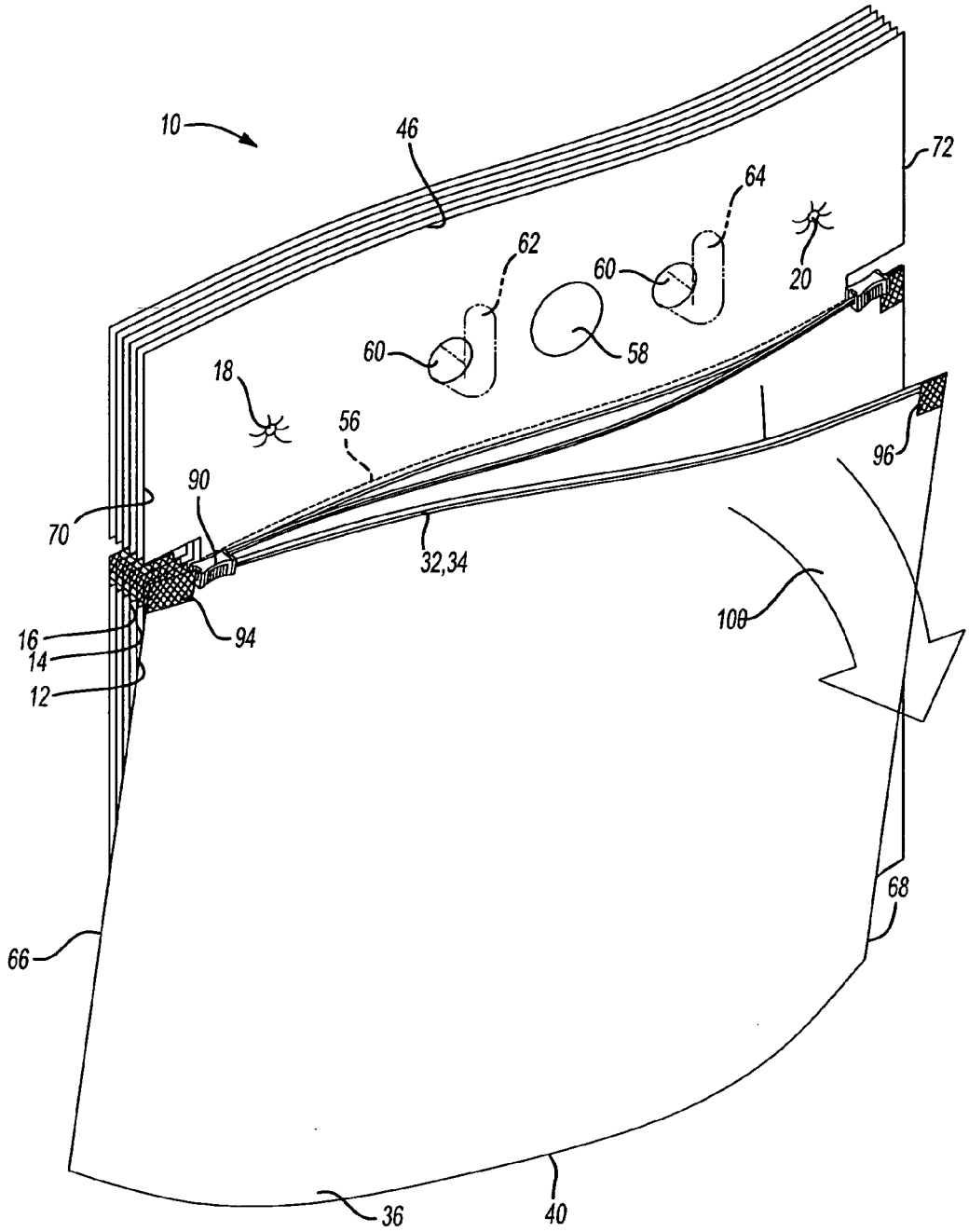
FIG. 2 is a succeeding view of the resealable bag illustrated in FIG. 1 and further showing the tear-away removal of a given bag from a given header portion, and such as after insertion and sealing of a product within the bag.
Figure 2A:
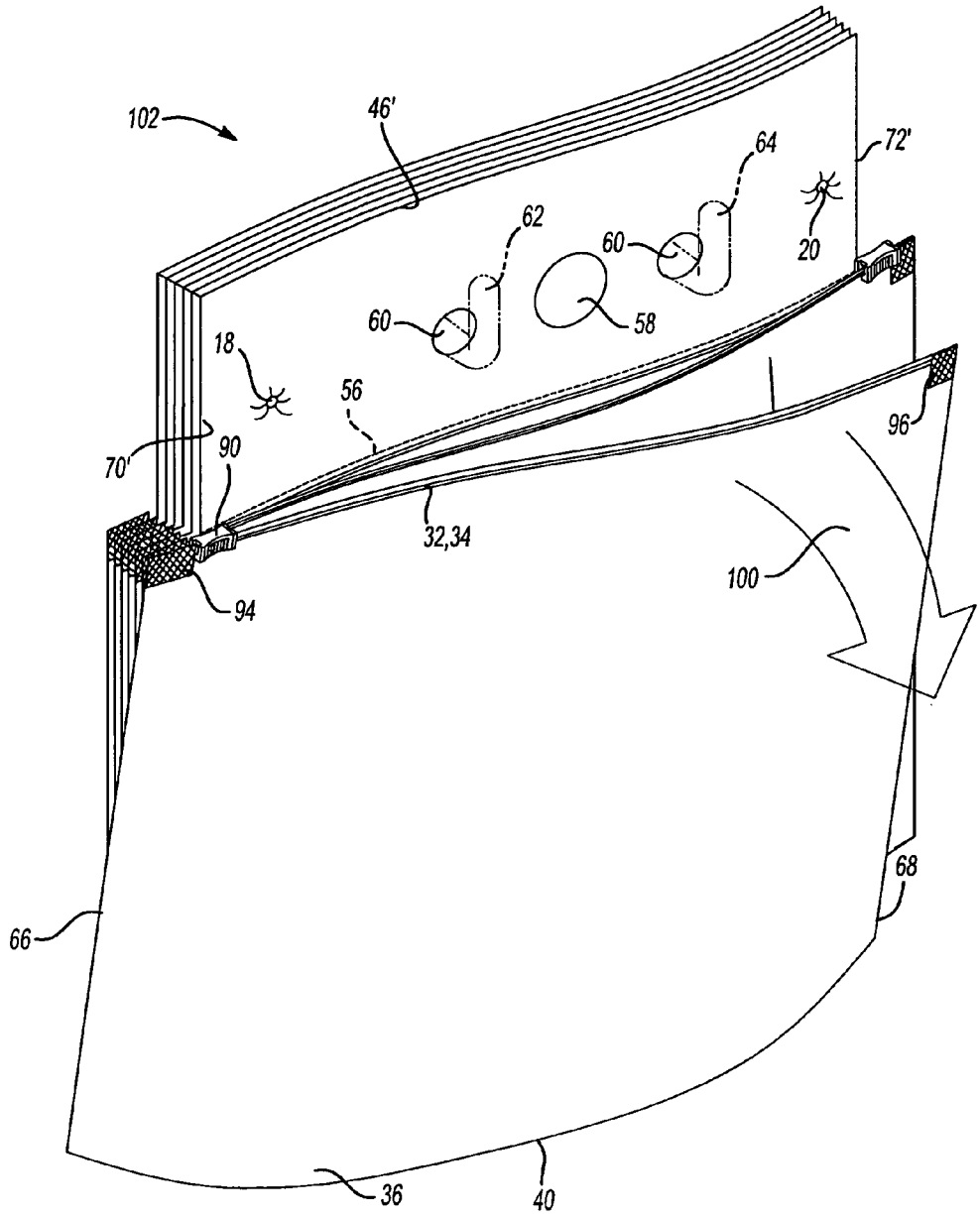
FIG. 2A is an illustration of a resealable bag substantially as shown in FIG. 2, with the exception that it illustrates a reduced width and tear-away header.

Referring to FIG. 2A, an illustration of a resealable bag is shown at 102, substantially as previously represented in FIG. 2, and with the exception that it illustrates a reduced width and tear-away header as evidenced by top 46' and sides 70' and 72'. Of additional note, the reduced width configuration of the headers dispenses with the need for creating the recessed notches as previously illustrated.

Figure 11:
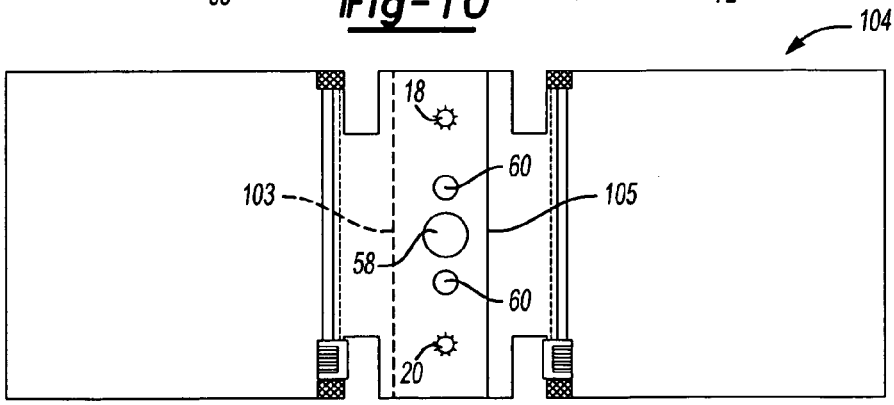
FIG. 11 is an illustration of a resealable plastic bag according to a further and dual saddlebag embodiment of the present invention.

Referring now to FIG. 11, an illustration is shown at 104 of a resealable plastic bag according to a further and dual saddlebag embodiment of the present invention and by which first and second reclosable bag portions are arranged on opposite sides of a common header. As explained previously, the saddlebag configuration allows a plurality of bags to be suspended on opposite facing sides of a saddle (not shown) or likewise supporting structure.

Figure 12:
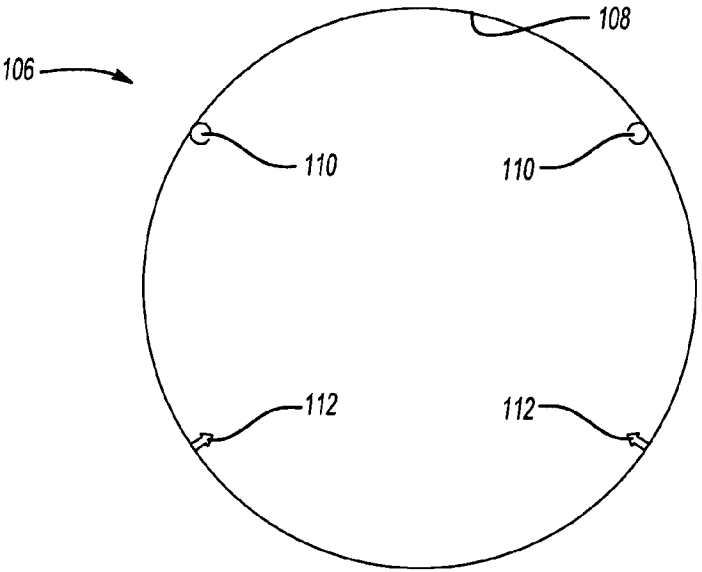
FIG. 12 is a two-dimensional end view of an extrusion die according to the further preferred embodiment of FIG. 11 and for producing the dual saddlebag plasticized bag according to the embodiment of FIG. 11.

FIG. 11 again further illustrates the features associated with the header portion, these namely including the heat staking portions 18 and 20, apertures 58 and 60, and in addition to scored line 103 and solid (ribbed) line 104. The bag 104 is substantially identical in configuration to that previously illustrated and described, with the exception that a modified die design, as further referenced at 106 in FIG. 12, is employed to create the bag 104. The die 106 again includes an arcuate inner surface 108, as well as first 110 and second 112 pairs of projections which again facilitate the creation of the re-sealable bead portions in the plasticized bag 104 thus created.

Figure 13:
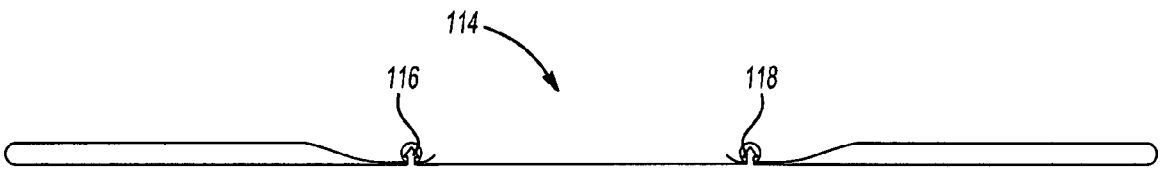
FIG. 13 is a further succeeding view of the bag illustrated in FIG. 12, showing the removal of the excess header portions, and according to the present invention.

Referring to FIG. 13, a two-dimensional end view 114 of the bag illustrated at 104 in FIG. 12, is illustrated and further showing the removal of the excess header portions (see knife cut edges at 116 and 118). Otherwise, and referring again to the plan view of FIG. 11, the pair of reclosable bags incorporated into the dual saddlebag variation 104 presents essentially the same features previously disclosed in the initial preferred embodiment and which, for the ease of illustration and description, need not be repetitively identified herein.

Figure 14:
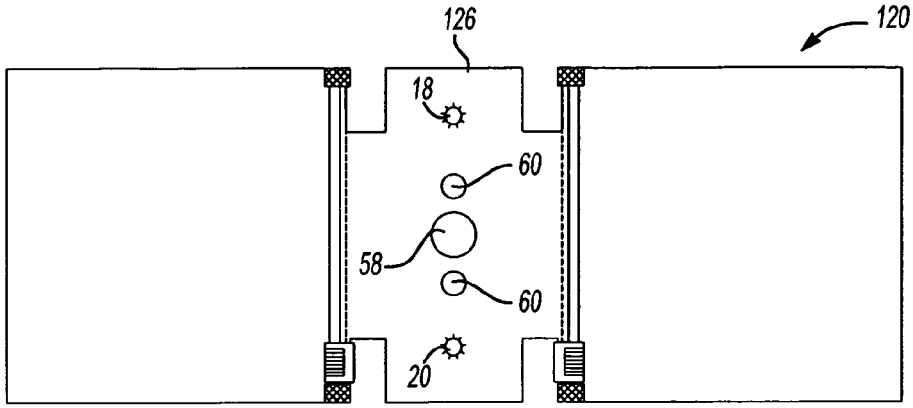
FIG. 14 is a variation of a one piece saddlebag design, similar to that previously shown in FIG. 11, and with the exception of the removal of the perforation and heat staking indications in the central header.
Figure 15:
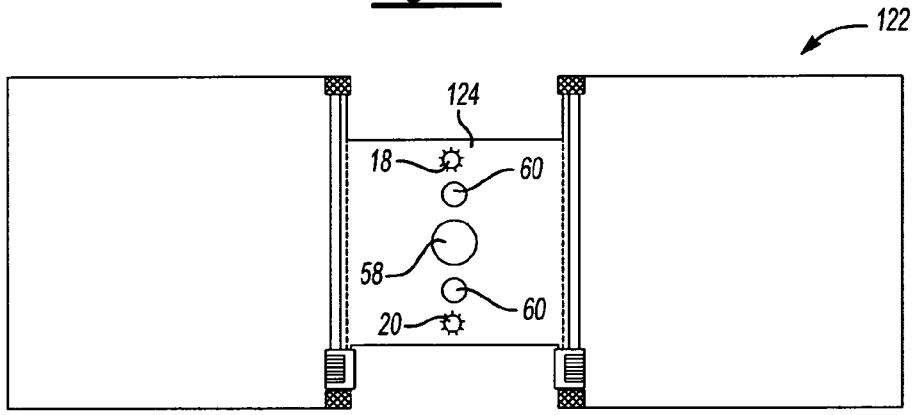
FIG. 15 is a further succeeding variation of a dual saddlebag arrangement and illustration a further configuration of an interconnecting header according to the present invention.

FIG. 14 illustrates at 120 a yet further variation of a one piece saddlebag design, similar to that previously shown in FIG. 11, and with the exception of the removal of the perforation and solid line indications (see previously at 103 and 105) in the central header. Referring further to FIG. 15, illustrated at 122 is a further succeeding variation of a dual saddlebag arrangement and illustration a further configuration of an interconnecting header according to the present invention. In particular, the header is illustrated at 124 in FIG. 15 and is established at a lesser width than that identified at 126 in FIG. 14. Otherwise, the header in each case again includes the same features, namely heat staking portions 18 and 20, as well as apertures 58 and 60.

Figure 16:
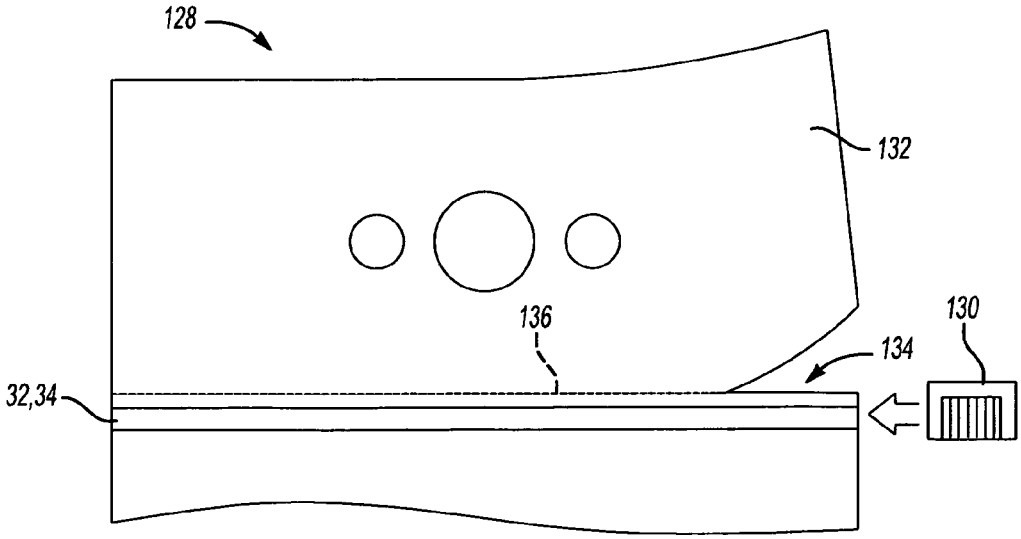
FIG. 16 illustrates a partial view of a resealable bag design according to a further preferred embodiment of the present invention and illustrating a combination traversable slider and tear-away header according to the present invention.

Referring now to FIG. 16, a partial view is illustrated at 128 of a resealable bag design according to a further preferred embodiment of the present invention. In particular, the bag 128 illustrates a combination traversable slider 130 and tear-away header 132. In use, a portion of the header 132 is detached from the reclosable bead portions, such as again at 32 and 34 associated with the bag, and as further referenced by detached edge 134 along perforation line 136.

Figure 17:
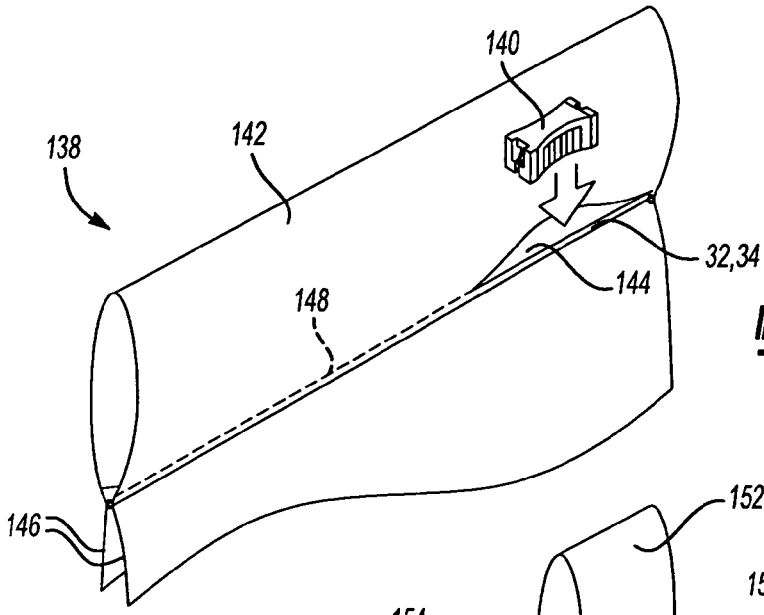
FIG. 17 is a sectional view in perspective of a resealable bag design according to a still further preferred embodiment of the present invention and illustrating one mounting arrangement of a zipper to a pair of reclosable openings and in proximity to a tear-away header portion.

Referring to FIG. 17, a sectional view in perspective is shown at 138 of a resealable bag design according to a still further preferred embodiment of the present invention and illustrating one mounting arrangement of a zipper 140 to a pair of reclosable openings (again such as at 32 and 34) in proximity to a tear-away header portion. The header portion 142 is illustrated in a closed loop fashion, and by which an edge portion 144 is detached from a reclosable bag portion 146 along a perforation line 148 and prior to installation of the zipper 140.

Figure 18:
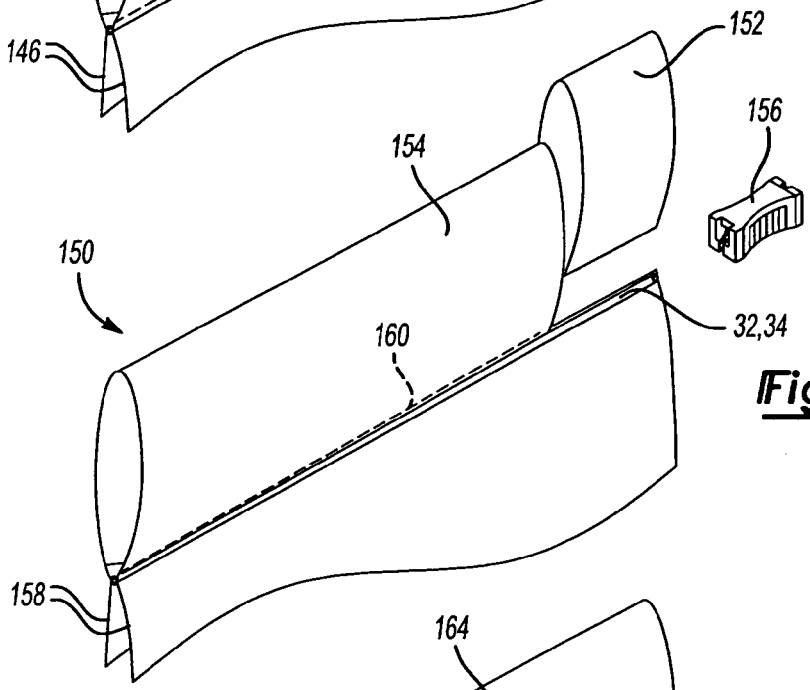
FIG. 18 is a succeeding sectional perspective illustration of a partially removable header portion and for facilitating attachment of a zipper according to a further preferred embodiment.

FIG. 18 illustrates at 150 a succeeding sectional perspective illustration of a partially removable header portion and reclosable bag, see portion 152 removable from main header portion 154 and for facilitating attachment of a zipper 156. Otherwise, the reclosable bag again includes main body portion 158, reclosable portions 32 and 34, and perforation line 160.

Figure 19:
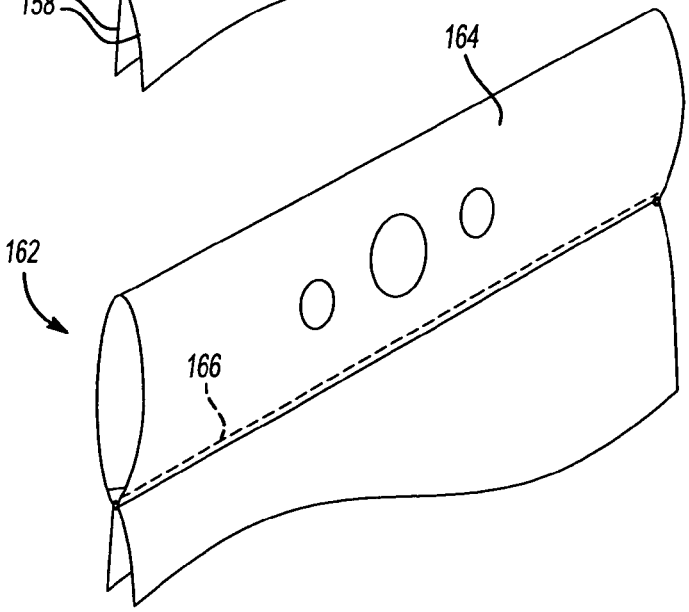
FIG. 19 is a yet further sectional perspective illustration of a perforated and tear-away header portion according to a further preferred embodiment of the present invention.

Finally, and referencing FIG. 19, a yet further sectional perspective illustration is given at 162 of a perforated and tear-away header portion, at 164 and including perforation line 166, according to a further preferred embodiment of the present invention. The design of FIG. 19 is understood to not include an attachable zipper and it is understood that, within the scope of the invention, a tear-away bag design can be created using the die extrusion process described herein and optionally without the provision of recessed notches and zippers.

A related method of manufacturing is also disclosed for producing a resealable bag according to the structure described above. The method includes, most broadly, the steps of extruding a body within a cylindrical shaped die, such that the body includes at least first and second resealable bead portions located at first and second width extending locations and flattening the planar shaped body upon removal from the die and such that said resealable bead portions are interengaged.

Additional steps include sectioning a width of the body, in proximity to the interengaged bead portions, and in order to define a first bag enclosure portion and a second header portion, as well as establishing a plurality of perforations, along the width of the header portion and proximate the resealable bead portions. Further steps include, among others, heat sealing first and second extending sides of the bag enclosure portion to define a scaled interior, attaching a zipper to the resealable bead portions at selected sectioned edge locations, and forming apertures in the header portions to facilitate suspending thereof of the resealable bags in top-loading fashion. Yet additional steps include the heat stapling together a plurality of header portions, associated with corresponding and tear-away attached main reclosable body portions, the extrusion of dual sided and saddlebag reclosable plastic bags, using common headers, as well as the step of extruding a plurality of strengthening ribs along the header portions.

Having described my invention, other and additional preferred embodiments will become apparent to those skilled in the art to which it pertains and without deviating from the scope of the appended claims:

I claim:

1. A resealable plastic bag, comprising: a substantially planar shaped body exhibiting first and second opposing and foldable panels, sealingly connected along a pair of sides and, in cooperation with a common bottom edge interconnecting said sides, forming an interior receptacle volume;

a pair of sealable bead portions, integrally formed into said planar shaped body and extending between said sides of said body;

an integrally formed header extending from a selected one of said bead portions;

a slider attachable to said bag, proximate a conjoining location associated with said bead portions and a removed portion of said header, permitting installation of said slider to contain said re-sealable bead portions therebetween; and a perforation line being established along said header, in close proximity and above said selected bead portion, in order to facilitate tear-away removal of said planar shaped body from said header substantially along said bead portion.

2. The resealable plastic bag according to claim 1, further comprising a pair of recessed notches formed in said bag, between opposite edges of said header and said re-sealable bead portions.

3. The resealable plastic bag according to claim 1, further comprising at least one aperture formed through said header and for mounting said header and bag in suspending fashion.

4. The resealable plastic bag according to claim 1, further comprising a portion of said header being sectioned during manufacture of said bag.

5. The resealable plastic bag according to claim 1, further comprising first and second planar shaped bodies arranged on opposite sides of said header.

6. The resealable plastic bag according to claim 1, said body having a specified shape and size, further comprising said slider being traversable across said bead portions and concurrently sectioning said body from said header along said perforation line.

7. The resealable plastic bag according to claim 1, further comprising said header exhibiting a width lesser than said body.

8. The resealable plastic bag according to claim 1, further comprising a portion of said header being detached form said body across said perforation line, in order facilitate installation of said slider.

9. A sealable plastic bag comprising:

a planar shaped body having first and second panels connected along opposite sides and a bottom to define an interior volume;

a pair of engageable bead portions formed along opposing inner facing surfaces of said panels between said sides;

a header extending from a selected one of said bead portions in a direction opposite a selected body defining panel, a perforation line extending within said header in parallel extending and approximate location to said selected bead portion; and a slider attachable to said bag proximate a conjoining edge location associated with said bead portions and a removed edge portion of said header permitting installation of said slider, separation of said bead portions permitting top loading of product within said interior volume of said body, prior to tear-away removal of said planar shaped body from said header along said bead portions.

10. The plastic bag as described in claim 9, further comprising traversing displacement of said slider along said bead portions sealing together said opposing bead portions concurrent with tear-away removal from said header portion.

11. The plastic bag as described in claim 9, further comprising at least one aperture formed through said header for mounting said header and body in suspending fashion.

12. The plastic bag as described in claim 9, further comprising a heat stapling process for securing together a plurality of headers associated with a like plurality of bodies.

13. A sealable plastic bag comprising:

a planar shaped body having first and second panels connected along opposite sides and a bottom to define an interior volume;

a pair of engageable bead portions formed along opposing inner facing surfaces of said panels between said sides;

a header extending from a selected one of said bead portions in a direction opposite a selected body defining panel, a perforation line extending within said header in parallel extending and approximate location to said selected bead portion; and a slider attachable to said bag proximate a conjoining location associated with said bead portions, anywhere between said opposite sides at which said header is detached from said perforation line to permit installation of said slider, separation of said bead portions permitting top loading of product within said interior volume of said body, prior to tear-away removal of said planar shaped body from said header along said bead portions.

* * * * *

UNITED STATES PATENT AND TRADEMARK OFFICE

CERTIFICATE OF CORRECTION

PATENT NO. : 7,134,788 B2
APPLICATION NO. : 10/459286
DATED : November 14, 2006
INVENTOR(S) : Chia H. Chang It is certified that error appears in the above-identified patent and that said Letters Patent is hereby corrected as shown below:

On Title Page Item (76)
In the Inventor please replace "Chia Hsiang" with
--Chia Hsiang Chang--

Signed and Sealed this

Thirteenth Day of March, 2007

JON W. DUDAS
*Director of the United States Patent and Trademark Office*